US010023981B2

(12) United States Patent
Gilbertson

(10) Patent No.: US 10,023,981 B2
(45) Date of Patent: Jul. 17, 2018

(54) 3D WOVEN PREFORMS WITH CHANNELS

(71) Applicant: Albany Engineered Composites, Inc., Rochester, NH (US)

(72) Inventor: Brock Gilbertson, Saco, ME (US)

(73) Assignee: Albany Engineered Composites, Inc., Rochester, NH (US)

( * ) Notice: Subject to any disclaimer, the term of this patent is extended or adjusted under 35 U.S.C. 154(b) by 0 days.

(21) Appl. No.: 15/291,418

(22) Filed: Oct. 12, 2016

(65) Prior Publication Data

US 2017/0101730 A1 Apr. 13, 2017

Related U.S. Application Data

(60) Provisional application No. 62/240,994, filed on Oct. 13, 2015.

(51) Int. Cl.

| | |
|---|---|
| ***D03D 25/00*** | (2006.01) |
| ***D03D 11/02*** | (2006.01) |
| ***D03D 19/00*** | (2006.01) |
| ***D03D 9/00*** | (2006.01) |
| ***D03D 11/00*** | (2006.01) |
| ***D03D 13/00*** | (2006.01) |

(52) U.S. Cl.

CPC ..... *D03D 25/005* (2013.01); *D03D 9/00* (2013.01); *D03D 11/00* (2013.01); *D03D 11/02* (2013.01); *D03D 13/004* (2013.01); *D03D 19/00* (2013.01); *D10B 2505/02* (2013.01)

(58) Field of Classification Search

None

See application file for complete search history.

(56) References Cited

U.S. PATENT DOCUMENTS

| | | | | |
|---|---|---|---|---|
| 4,015,038 | A | 3/1977 | Romanski et al. | |
| 4,134,397 | A | 1/1979 | Gianakakos et al. | |
| 5,217,048 | A * | 6/1993 | Takano | D03C 7/00 139/409 |
| 5,425,985 | A | 6/1995 | Irvin | |
| 5,458,693 | A | 10/1995 | Codorniu | |
| 6,103,337 | A | 8/2000 | Burgess | |
| 6,174,825 | B1 | 1/2001 | Dutt | |
| 6,261,675 | B1 | 7/2001 | Hsiao et al. | |
| 6,378,566 | B1 | 4/2002 | Kornett | |
| 6,475,596 | B2 | 11/2002 | Hsiao et al. | |
| 6,663,737 | B2 | 12/2003 | Hsiao et al. | |
| RE39,176 | E | 7/2006 | Dutt | |
| 7,972,983 | B2 | 7/2011 | Taylor et al. | |
| 2004/0118474 | A1 | 6/2004 | Birzele | |

(Continued)

FOREIGN PATENT DOCUMENTS

| | | |
|---|---|---|
| DE | 19737219 A1 | 3/1999 |
| EP | 2 347 889 A1 | 7/2011 |

OTHER PUBLICATIONS

International Search Report and Written Opinion prepared by the European Patent Office acting as the ISA, for international application PCT/US2016/056554 dated Jan. 25, 2017.

(Continued)

*Primary Examiner* — Shawn Mckinnon

(74) *Attorney, Agent, or Firm* — McCarter & English, LLP

(57) ABSTRACT

A three-dimensional (3D) woven preform with channels in the through thickness direction developed for applications such as forming light weight preforms with an increased thickness.

10 Claims, 15 Drawing Sheets

(56) References Cited

U.S. PATENT DOCUMENTS

| | | | |
|---|---|---|---|
| 2014/0161626 | A1 | 6/2014 | Podgorski et al. |
| 2014/0174632 | A1 | 6/2014 | Roman et al. |
| 2014/0174641 | A1 | 6/2014 | Roman et al. |

OTHER PUBLICATIONS

Shinn, W.E. et al.: "Leno Weaving and Design, Part 2", *The Melliard*, vol. 2, No. 2, May 1930, pp. 195-201.

* cited by examiner

Related Art
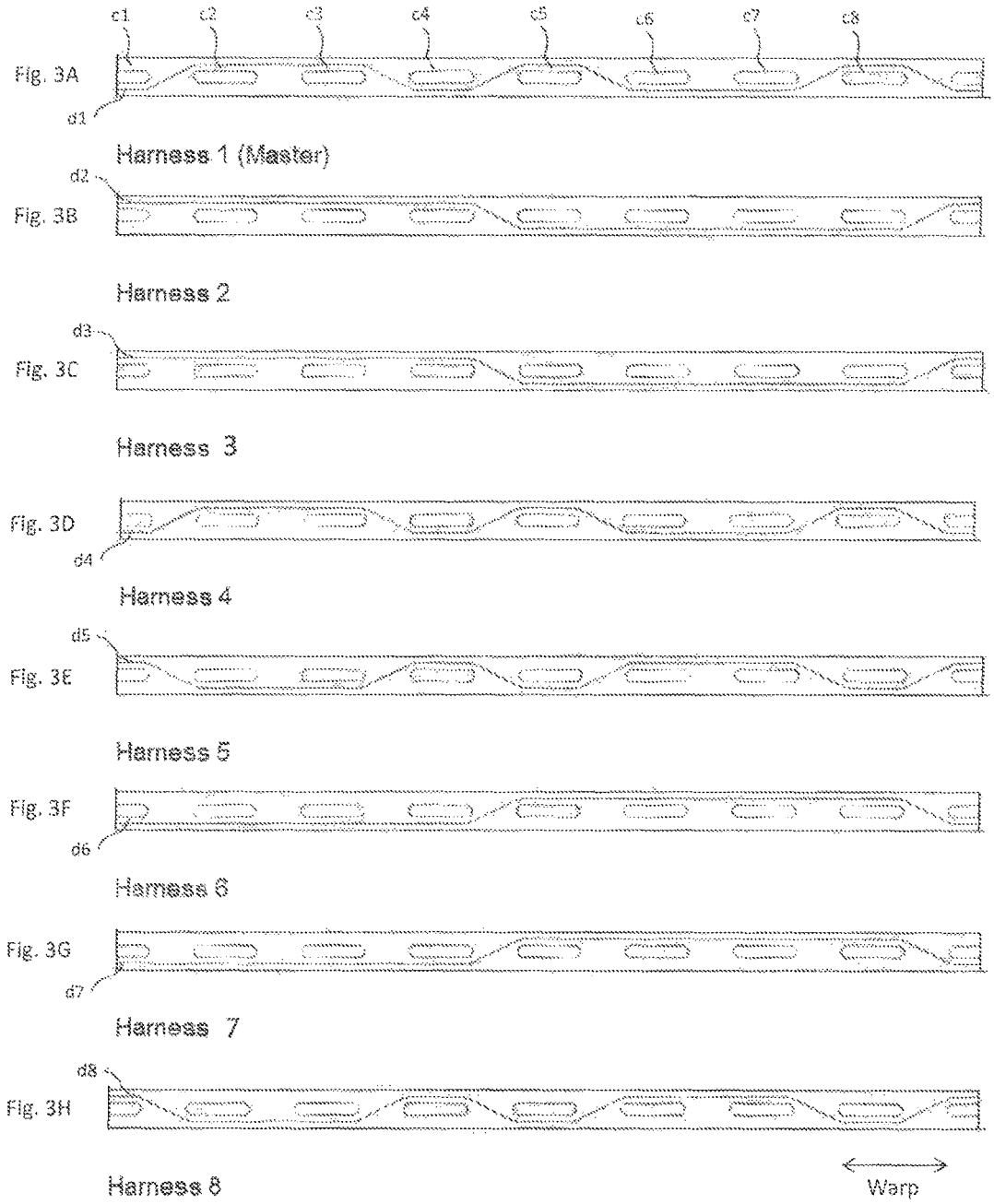

3D WOVEN PREFORMS WITH CHANNELS

This application relates to a three-dimensional (3D) preform with channels through the thickness of the preform that may be used in applications such as forming light weight preforms with an increased thickness.

DESCRIPTION OF RELATED ART

A leno weave is a weave in which two warp yarns are twisted around the weft yarns to provide a strong yet sheer/open fabric. The traditional leno, a single layer weave structure, is made by wrapping the warp yarns around each other between weft yarns. A variety of mechanical means are used, such as horizontally translating one warp to the other side of its neighbor with a mechanical actuator; using a propeller device that spins one direction for a long time, then spins the other direction, etc. A traditional leno weave acts to keep the two yarns locked very close to each other to either make an open fabric (like gauze), or to lock nearby yarn ends in place.

The leno weave (also called Gauze Weave or Cross Weave) is a weave in which two warp yarns are twisted around the weft yarns to provide a strong yet sheer/open fabric. The standard warp yarn is paired with a skeleton or 'doup' yarn; these twisted warp yarns grip tightly to the weft yarn which improves the durability of the fabric. A leno weave produces an open fabric with almost no yarn slippage or misplacement of yarns.

A leno weave fabric allows light and air to pass through freely so are used in any area where a sheer, open weave fabric is required that will not bruise or shove (where the yarns shift away from their woven uniformity disturbing the uniformity of the weave). If a simple in-and-out flat weave were woven very loosely to achieve the same effect, the yarns would have a tendency to this bruising/shoving/misplacement.

Mock lenos, also known as imitation lenos, are a variety of weaves of ordinary construction which produce effects that are similar in appearance to the gauze or leno styles obtained without the aid of a doup mounting, These weaves are generally produced in combination with plain, twill, satin or other simple single layer weaves or even with brocade configuring, to produce striped fabrics, which bear a very close resemblance to true leno fabrics. This weave is also referred to as imitation gauze weave.

The weave is a single layer weave arranging yarns in groups of equal or unequal sizes. Yarns working in a plain weave alternate with yarns floating on the face or back of the fabric. The yarn ends from each individual yarn group can be drawn into the same dent; this bunches the floating yarn ends together and causes a slight gap or opening between yarn groups in the fabric giving an appearance similar to a gauze or leno weave, hence the name "mock leno".

Mock leno woven fabrics may be generally defined as fabrics wherein groups of three or more warp or weft yarns are interlaced in such a way that the yarns of each group can come together easily in one group, while they are separated from the adjacent groups by reason of the last yarn of one group and the first yarn of the next group being interlaced in directly opposite order. Such an intersection prevents the two adjacent yarns from coming together and causes an opening at this point. These single layer woven fabrics may, be made from fibers or yarns of any well-known weavable materials such as glass or cotton, and are well known articles of commerce.

FIG. 1A illustrates an example of a related art single-layer mock leno fabric structure 1000 wherein both the warp and the weft yarns are grouped in groups of three yarns each. As shown in FIG. 1A, the fabric comprises two kinds of mock leno patterns, i.e., 3×3 mock leno pattern I, and 3×3 mock leno pattern II. The 3×3 mock leno pattern I is formed by a group of three weft yarns a1-a3 and a group of three warp yarns b1-b3, and the 3×3 mock lend pattern II is formed by a group of three weft yarns a1-a3 and a group of three warp yarns b4-b6. The group of weft yarns a1-a3 includes a first edge yarn a1, a central yarn a2, and a second edge yarn a3. The group of warp yarns b1-b3 includes a first edge yarn b1, a central yarn b2, and a second edge yarn b3. Similarly, the group of warp yarns b4-b6 includes a first edge yarn b4, a central yarn b5, and a second edge yarn b6.

As shown in FIG. 1A, during the weaving of the 3×3 mock leno pattern I, both of the first edge warp yarn b1 and the second edge warp yarn b3 are woven under the first edge weft yarn a1, then over the central weft yarn a2, and finally under the second weft edge yarn a3. The central warp yarn b2 is woven over all of the three weft yarns a1-a3. During the weaving of the 3×3 mock leno pattern II, both of the first edge warp yarn b4 and the second edge warp yarn b6 are woven over the first edge weft yarn a1, then under the central weft yarn a2, and finally over the second weft edge yarn a3. The central warp yarn b5 is woven under all of the three weft yarns a1-a3.

FIG. 1B illustrates the interlacing of the yarns of another example of a single-layer mock leno weave fabric structure wherein both the warp and the weft yarns are also grouped in groups of three yarns each. As shown in FIG. 1B, there are sections where all of the weft yarns cross between two warp yarns as indicated by the circle. Within the groupings of three warp yarns, weft yarns do cross between a pair of warp yarns, but not all weft yarns cross at the same time.

FIG. 1C illustrates another example of a single-layer mock leno weave fabric structure. This mock leno is another version of a plain weave in which occasional warp yarns, at regular intervals but usually several yarns apart, deviate from the alternate under-over interlacing and instead interlace every two or more yarns. This happens with similar frequency in the weft direction, and the overall effect is a fabric with increased thickness and a rougher surface.

FIG. 2 illustrates another example of a single-layer mock leno weave fabric structure 2000 wherein both the warp and the weft yarns are grouped in groups of four yarns each. As shown in FIG. 2, the fabric comprises two kinds of mock leno patterns, i.e., 4×4 mock lend pattern I, and 4×4 mock leno pattern II. The 4×4 mock leno pattern I is formed by a group of four weft yarns c1-c4 and a group of four warp yarns d1-d4, and the 4×4 mock leno pattern II is disrupted by a group of four weft yarns c1-c4 and a group of four warp yarns d5-d8. Similarly, a group of four weft yarns c5-c6 and a group of four warp yarns d1-d4 form the 4×4 mock leno pattern II, and a group of four weft yarns c5-c8 and a group of four warp yarns d5-d8 form the 4×4 mock leno pattern I.

The group of weft yarns c1-c4 includes a first edge yarn c1, two central yarns c2 and c3, and a second edge yarn c4. Similarly, the group of weft yarns c5-c8 includes a first edge yarn c5, two central yarns c6 and c7, and a second edge yarn c8. The group of warp yarns d1-d4 includes a first edge yarn d1, two central yarns d2 and d3, and a second edge yarn d4, Similarly, the group of warp yarns d5-d8 includes a first edge yarn d5, two central yarns d6 and d7, and a second edge yarn d8.

FIGS. 3A-3H illustrate sections along the warp yarns d1-d8, respectively, in the single-layer mock leno weave fabric structure 2000 shown in FIG. 2. As shown in FIGS. 3A-3D, during the weaving of the 4×4 mock leno pattern I, both of the first edge warp yarn d1 and the second edge warp yarn d4 are woven under the first edge weft yarn c1, then over all the central weft yarns c2 and c3, and finally under the second weft edge yarn c4, The two central warp yarns d2 and d3 are woven over all of the four weft yarns c1-c4. During the weaving of the 4×4 mock leno pattern II on the right side of the 4×4 mock leno pattern I, both of the first edge warp yarn d1 and the second edge warp yarn d4 are woven over the first edge weft yarn c5, then under the central weft yarns c6 and c7, and finally over the second weft edge yarn c8. The two central warp yarns d2 and d3 are woven under all of the four weft yarns c5-c8.

As shown in FIGS. 3E-3H, during the weaving of the 4×4 mock leno pattern II, both of the first edge warp yarn d5 and the second edge warp yarn d8 are woven over the first edge weft yarn c1, then under all the central weft yarns c2 and c3, and finally over the second weft edge yarn c4, The two central warp yarns d6 and d7 are woven under all of the four weft yarns c1-c4. During the weaving of the 4×4 mock leno pattern I on the right side of the 4×4 mock leno pattern II, both of the first edge warp yarn d5 and the second edge warp yarn d8 are woven under the first edge weft yarn c5, then over the central weft yarns c6 and c7, and finally under the second weft edge yarn c8, The two central warp yarns d6 and d7 are woven over all of the four weft yarns c5-c8.

SUMMARY OF THE DISCLOSURE

A three dimensional (3D) woven preform with large channels in the warp and weft directions can be used itself or as part of a composite structure requiring light weight at an increased thickness versus other 3D or laminated preform structures. For 3D woven preforms that will be densified by Chemical Vapor Infiltration (CVI), larger channels within a preform can also provide multiple, large pathways for the chemical vapor to pass through the preform. In addition, the 3D weave that creates the channels can also create a preform with high thickness and a low fiber volume that might or might not be densified. Such an architecture might be useful in the preform state as a lightweight thermal or electrical insulator between two surfaces. The present invention discloses a 3D woven preform with channels. In the 3D woven version, warp yarns cluster together and weft yarns cluster together in groups. This creates channels in the through-thickness direction. These channels are created by locking the warp and weft yarns into place through a unique series of 3D weave patterns using a concept similar to the single layer mock leno weave. This differs from the traditional single layer leno pattern that is achieved through the use of a mechanical device that twists a warp yarn around another warp yarn as they cross a weft yarn to look them all into place. The traditional style leno mechanical devices are typically used in single layer preform weaves for composites for selvedges of the single layer woven preforms, where a tight weave is required to prevent-yarns from sliding out of place.

In one aspect of the disclosure, a three-dimensional (3D) woven preform can include a plurality of groups of warp yarns and a plurality of groups of weft yarns, the warp yarns woven with the weft yarns to form a mock leno structure having a plurality of layers of the 3D woven preform. A first group of warp yarns in a particular layer can include a first set of at least one warp central yarn that binds weft yarns in the particular layer to weft yarns in a subsequent layer and at least two first warp edge yarns, one on each side of the first set of the at least one warp central yarn. A second group of warp yarns in the particular layer can include a second set of at least one warp central yarn that binds weft yarns in the particular layer to weft yarns in a preceding layer and at least two second warp edge yarns, one on each side of the second set of the at least one warp central yarn, such that through thickness channels are formed in the multilayer preform.

This 3D woven preform of can include in a first group of weft yarns in the particular layer can include a first set of at least one weft central yarn that binds warp yarns in the particular layer to warp yarns in the subsequent layer and at least two first weft edge yarns, one on each side of the first set of the at least one weft central yarn. Also included can be a second group of weft yarns in the particular layer that can include a second set of at least one weft central yarn that binds warp yarns in the particular layer to warp yarns in the preceding layer and at least two second weft edge yarns, one on each side of the second set of the at least one weft central yarn. The first and second warp edge yarns can be woven over the first set of at least one weft central yarn and under the second set of at least one weft central yarn in the particular layer. The first and second weft edge yarns can be woven over the first set of at least one warp central yarn and under the second set of at least one warp central yarn in the particular layer.

Another aspect of the disclosure is a three-dimensional (3D) woven preform including a plurality of groups of warp yarns and a plurality of groups of weft yarns, the warp yarns woven with the weft yarns to form a mock leno structure having a plurality of layers of the 3D woven preform. A first group of weft yarns in a particular layer can include a first set of at least one weft central yarn that binds warp yarns in the particular layer to warp yarns in a subsequent layer and at least two first weft edge yarns, one on each side of the first set of the at least one weft central yarn. A second group of weft yarns in the particular layer can include a second set of at least one weft central yarn that binds warp yarns in the particular layer to warp yarns in a preceding layer and at least two second weft edge yarns, one on each side of the second set of the at least one weft central yarn, such that through thickness channels are formed in the multilayer preform.

In this second aspect of the 3D woven preform, a first group of warp yarns in the particular layer can include a first set of at least one warp central yarn that binds weft yarns in the particular layer to weft yarns in the subsequent layer and at least two first warp edge yarns, one on each side of the first set of the at least one warp central yarn. A second group of warp yarns in the particular layer can include a second set of at least one warp central yarn that binds weft yarns in the particular layer to weft yarns in the preceding layer and at least two second warp edge yarns, one on each side of the second set of the at least one warp central yarn. The first and second weft edge yarns can be woven over the first set of at least one warp central yarn and under the second set of at least one warp central yarn in the particular layer. The first and second warp edge yarns can be woven over the first set of at least one weft central yarn and under the second set of at least one weft central yarn in the particular layer.

It is noted that in this disclosure and particularly in the claims and/or paragraphs, terms such as "comprises", "comprised", "comprising" and the like can have the meaning attributed to it in U.S. Patent law; e.g., they can mean "includes", "included", "including", and the like.

The terms "threads", "fibers", "tows" and "yarns" are used interchangeably in the following description. "Threads", "fibers", "tows" and "yarns" as used herein can refer to monofilaments, multifilament yarns, twisted yarns, multifilament tows, textured yarns, braided tows, coated yarns, bicomponent yarns, as well as yarns made from stretch broken fibers of any materials known to those skilled in the art.

The above and other objects, features, and advantages of various embodiments as set forth in the present disclosure will be more apparent from the following detailed description of embodiments taken in conjunction with the accompanying drawings.

BRIEF DESCRIPTION OF THE DRAWINGS

FIGS. 3A-3H illustrate sections along the warp yarns in the single-layer mock leno weave fabric structure shown in FIG. 2.

DETAILED DESCRIPTION

Figure 1A:
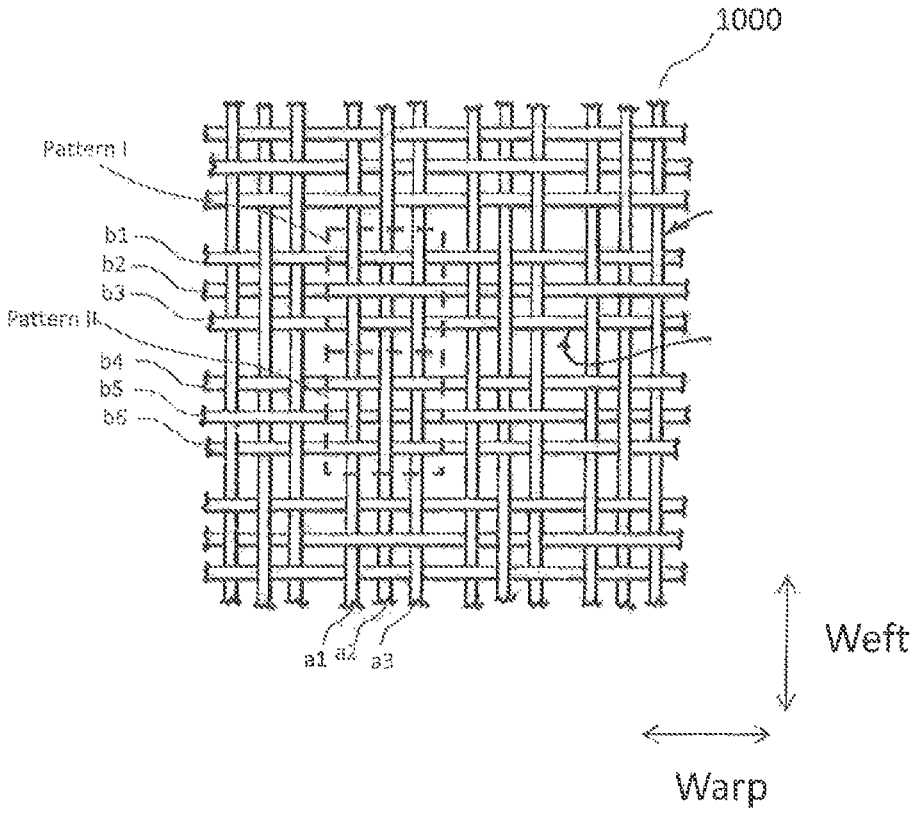
Fig. 1A Related Art
FIG. 1A illustrates an example of a related art single-layer mock leno weave fabric structure wherein both the warp and the weft yarns are grouped in threes.
Figure 1B:
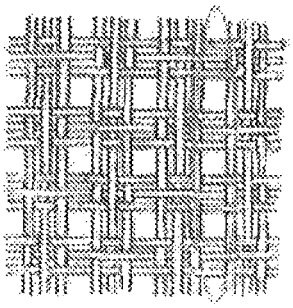
Fig. 1B Related Art
FIG. 1B illustrates another example of a related art single-layer mock leno weave fabric structure wherein both the warp and the weft yarns are grouped in threes.
Figure 1C:
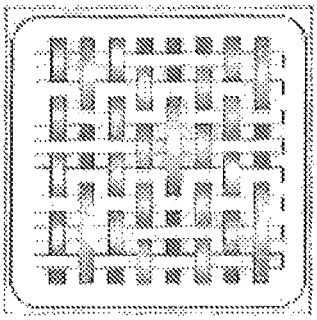
Fig. 1C Related Art
FIG. 1C illustrates another example of a related art single-layer mock lend weave fabric structure.
Figure 2:
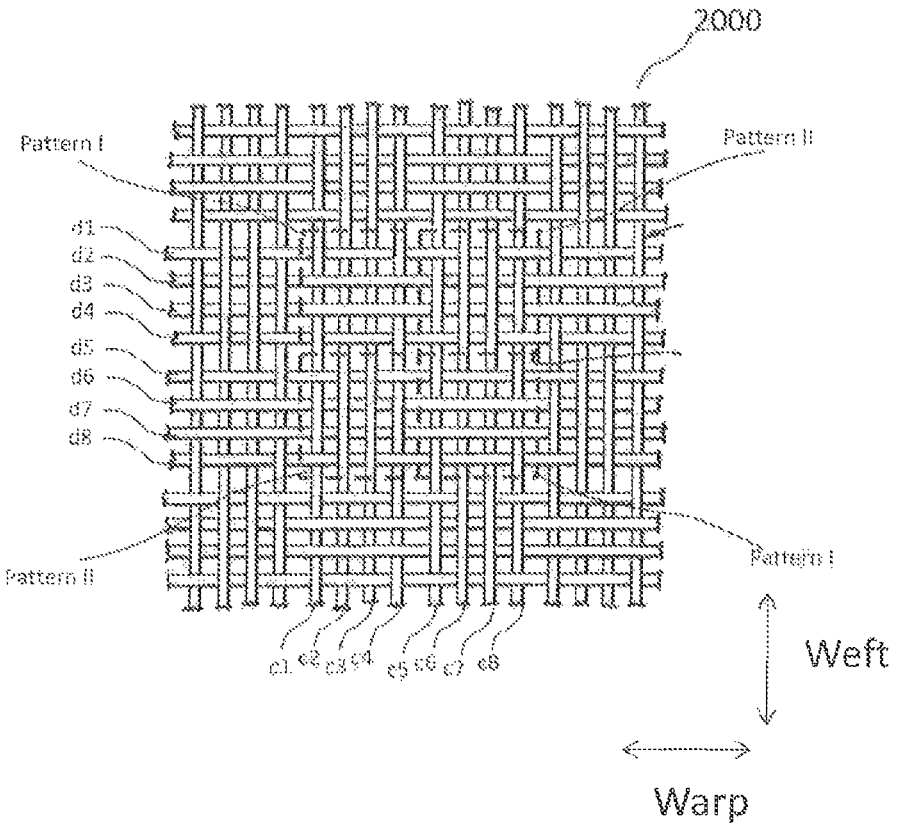
Fig. 2 Related Art
FIG. 2 illustrates another example of a related art single-layer mock leno weave fabric structure wherein both the warp and the weft yarns are grouped in fours.
Figure 4A:
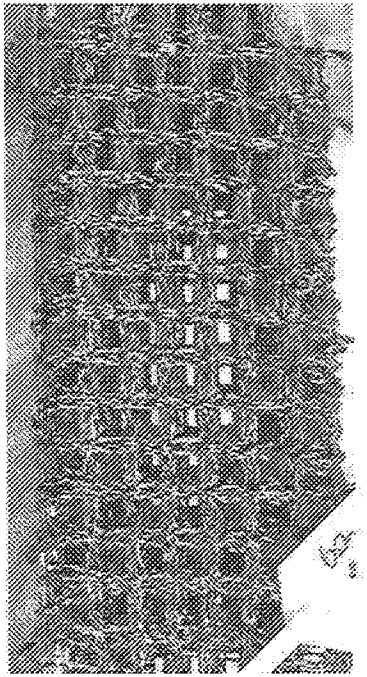
FIG. 4A illustrates a top view of an example of a 3D woven preform with channels of the present disclosure.
Figure 4B:
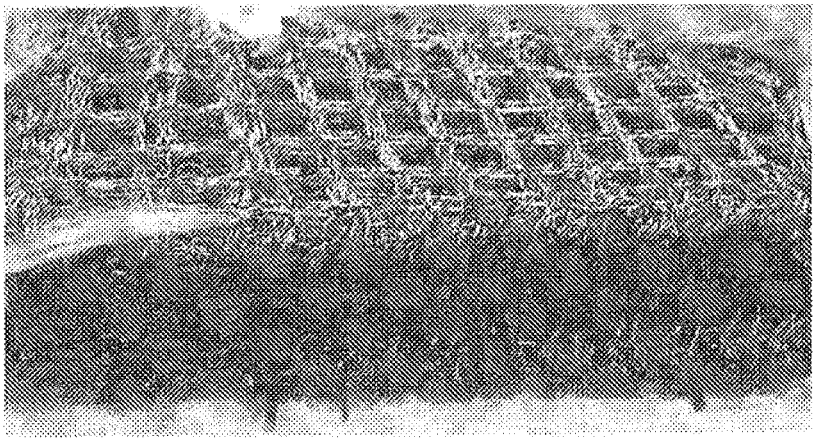
FIG. 4B illustrates an oblique view of the 3D woven preform with channels.

FIG. 4A illustrates a top view of an example of 3D woven preform with channels of the present disclosure. FIG. 4B illustrates an oblique view of the 3D woven preform with channels. As shown in FIGS. 4A-4B, the 3D woven preform with channels of the present disclosure includes a multi-layer mock leno weave fabric structure wherein both the warp and the weft-yarns are grouped in fours.

The 3D woven preform may comprise two kinds of 3D mock leno weave patterns, i.e., 3D mock leno weave pattern I, and 3D mock leno weave pattern II. FIGS. 5A-5D show an example of 3D mock leno weave pattern I, and FIGS. 5E-5H show an example of 3D mock leno weave pattern II. Both of the 3D mock leno weave patterns I and II are formed by a group of four warp yarns and a group of four weft yarns in a plurality of layers. Each group of four warp yarns includes a first edge warp yarn, two central warp yarns, and a second edge warp-yarn, the edge yarns on opposite sides of the central yarns. Similarly, each group of four weft yarns includes a first edge weft yarn, two central weft yarns, and a second edge weft yarn, the edge yarns on opposites of the central yarns.

A 4×4 (4 warp yarns in each group and 4 weft yarns in each group) mock leno weave pattern is illustrated and described, However, it should be appreciated that there do not necessarily have to be an equal number of yarns in the warp and weft yarn groups. Moreover, it is not necessary to have 4 yarns in a group as long as there is at least one central yarn and at least one edge yarn on either side of the central yarn in each warp and weft group.

In the 4×4 3D mock leno weave patterns I shown in FIGS. 5A-5D, there are two central warp yarns in the warp yarn group in a particular layer, e.g. layer n, that alternate between being woven over all of the four yarns in the weft yarn group in the same layer n, and then woven under all of the four yarns in the weft yarn group in the next layer n+1, which is under this particular layer n in the through-thickness direction.

In the 3D mock leno weave patterns II shown in FIGS. 5E-5H, there are two central warp yarns in the warp yarn group in a particular layer, e.g. layer n, that alternate between being woven under all of the four yarns in the warp yarn group in the same layer n, and then woven over all of the four yarns in the warp yarn group in the upper layer n−1, which is over this particular layer n in the through-thickness layers of the fabric.

In more detail, FIGS. 5A-5H illustrate sections along two groups of warp yarns in the 3D woven preform which structure has, for example, 12 layers. As shown in FIGS. 5A-5H, the two groups of warp yarns include warp yarns 11-14 of a first warp group and warp yarns 15-18 of a second warp group in the first layer of the 3D preform. Also illustrated are warp yarns 21-24 and 25-28 of first and second warp groups of the second layer. This pattern continues to warp yarns 111-114; 115-118 of first and second warp groups of the eleventh layer, and warp yarns 121-124 and 125-128 of first and second warp groups of the twelfth layer.

FIGS. 5A-5H also show two groups of 4 weft yarns each that includes weft yarns 54, 69, 78, and 93 in a first weft yarn group and weft yarns 49, 63, 73, and 87 in a second weft yarn group on the first layer of the 3D woven preform, and two groups of 4 weft yarns that includes weft yarns 56, 67, 80, and 91 in a first weft yarn group and weft yarns 52, 71, 76, and 95 in a second weft yarn group on the second layer. The weft groupings continue in a similar manner to two groups of weft yarns 58, 65, 82, and 89 in a first weft yarn group 59, 64, 83, and 88 in a second weft yarn group in the tenth layer, weft yarns 60, 62, 84, and 86 in a first weft yarn group and weft yarns 51, 61, 75, and 85 in a second weft yarn group in the eleventh layer.

In the following discussion the term "subsequent layer" is used for convenience of discussion only. However, "subsequent layer" as used herein means "another layer" not necessarily a layer lower or deeper in the 3D preform than a particular layer. Indeed, a "subsequent layer" could be above or higher in the 3D preform than the particular layer, The term "preceding layer" is only used to describe a layer in a direction opposite to that of the "subsequent layer."

Figure 5A:
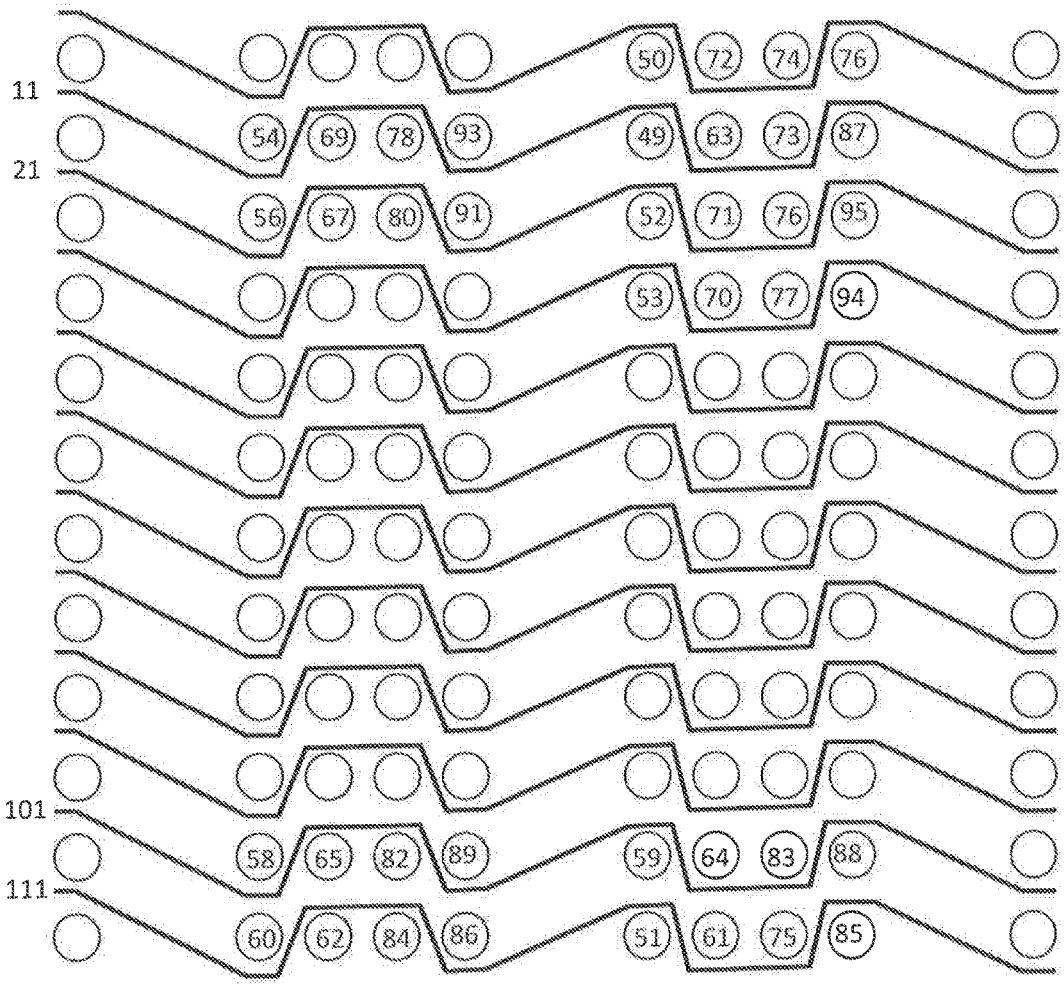
FIGS. 5A-5H illustrate sections along the warp yarns in the 3D woven preform of the present disclosure.
Figure 5B:
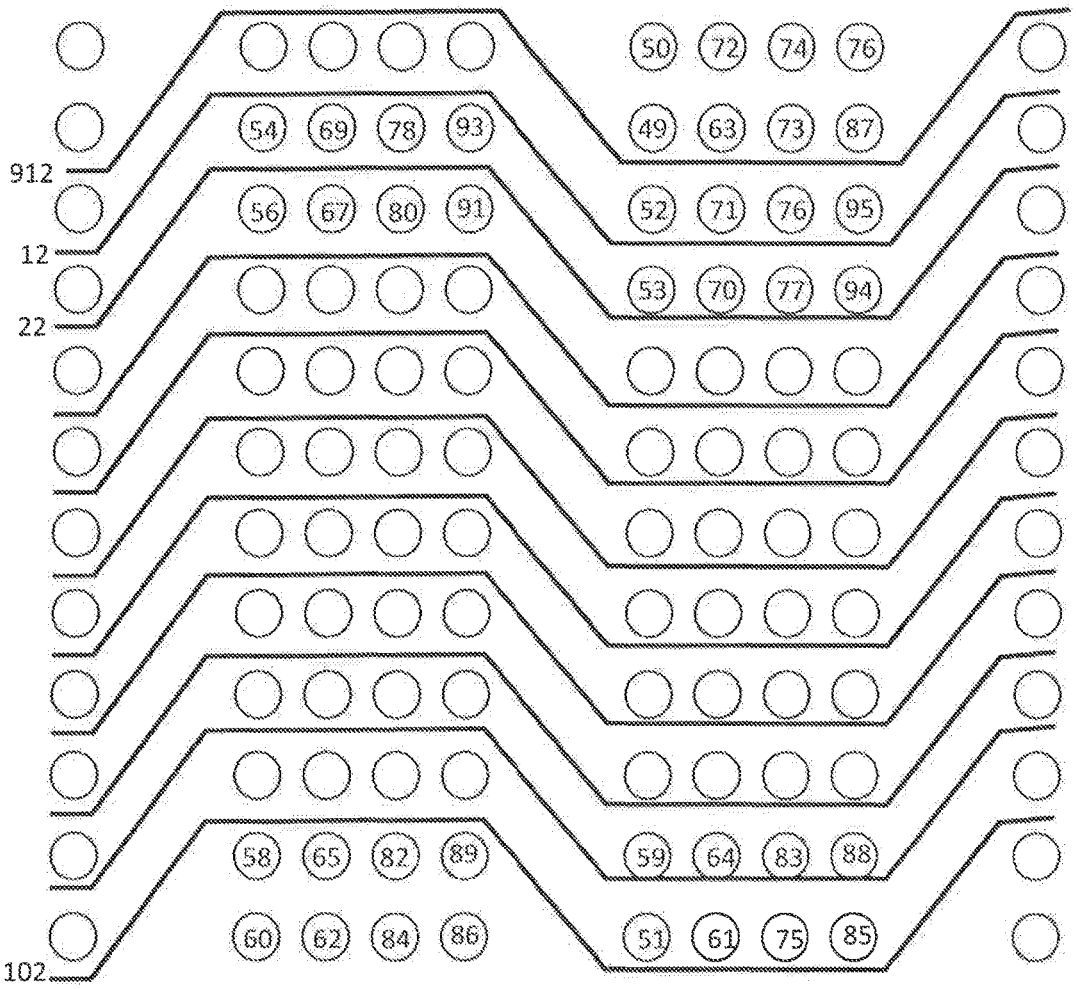
Figure 5C:
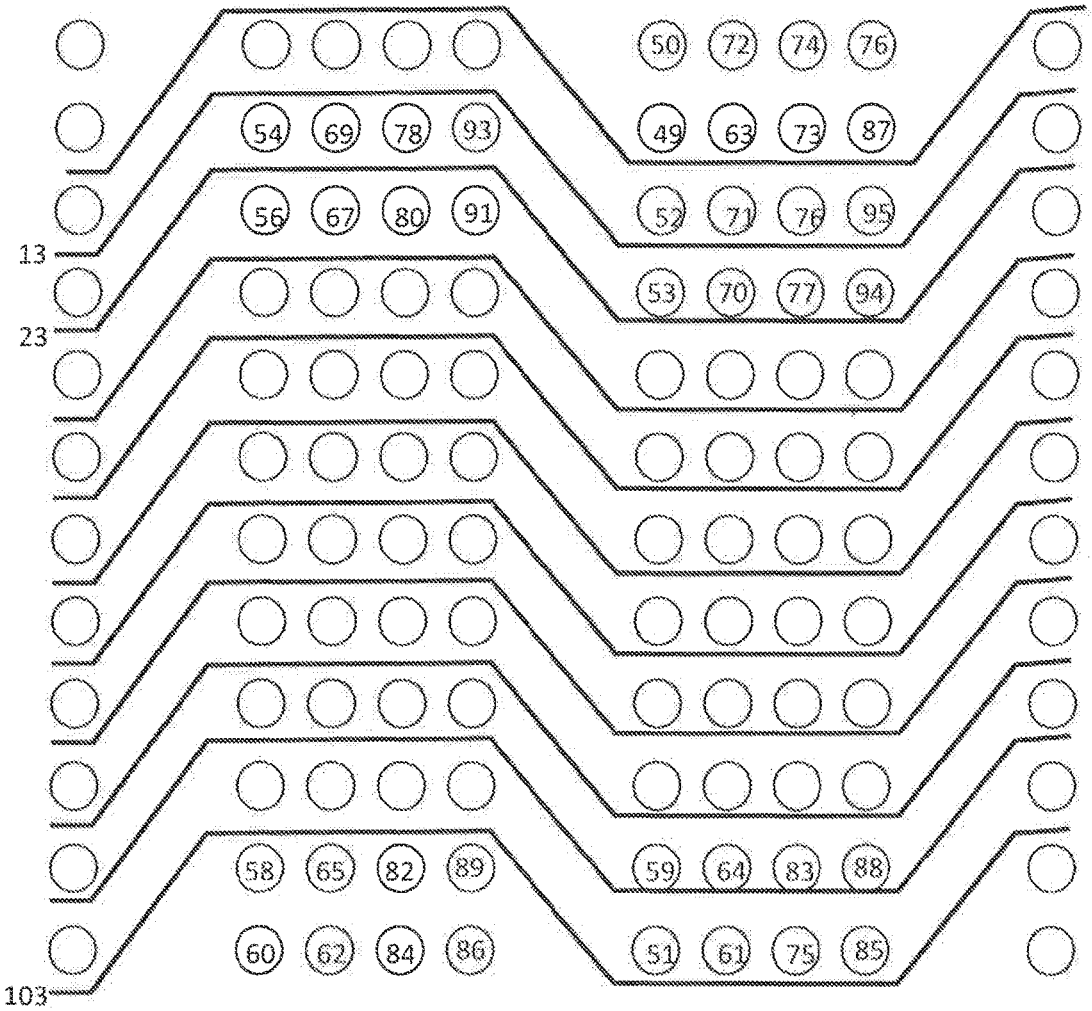
Figure 5D:
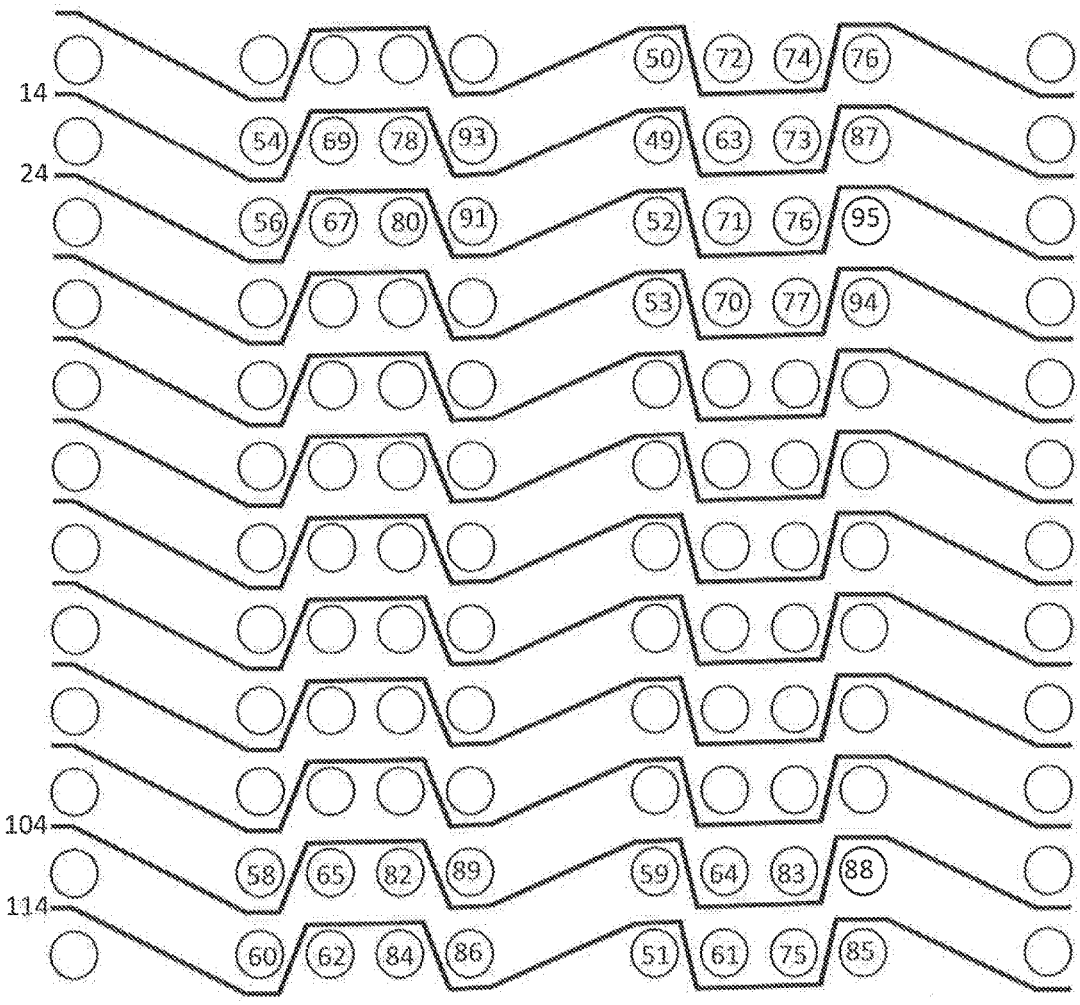

As shown in FIGS. 5A and 5D there are 4 yarns in a first group of warp yarns: warp yarns 11, 14, one on either side of central yarns 12, 13. During the weaving of the 3D mock leno weave pattern I, the first edge warp yarn 11 and the second edge warp yarn 14 are woven under the first edge weft yarn 54 of the first weft yarn group of the first layer, then over all the central weft yarns 69 and 78, and finally under the second weft edge yarn 93 in the weft yarn group. Edge warp yarns 11, 14 are then woven over the first edge weft yarn 49 of the first layer, then under all the central weft yarns 63 and 73, and finally over the second weft edge yarn 87. Edge warp yarns 11, 14 alternate the over/under in this manner for subsequent columns of weft yarns.

As shown in FIGS. 5B and 5C, the two central warp yarns 12 and 13 of the warp yarn group 11-14 in the first layer are woven over all of the four weft yarns 54, 69, 78, and 93 of the first layer and under the four weft yarns 52, 71, 76, and 95 of the second layer. Therefore, the first layer and the second layer are tied to each other.

In a similar manner, the first edge warp yarn 21 and second edge warp yarn 24 of the warp yarn group 21-24 in the second layer are woven under the first edge weft yarn 56 of the first weft yarn group of the second layer, then over the central weft yarns 67 and 80, and under the second weft edge yarn 91. And the first edge warp yarn 21 and the second edge warp yarn 24 are woven over the first edge weft yarn 52 of the second weft yarn group of the second layer, then under the central weft yarns 71 and 76, and finally over the second weft edge yarn 95.

The two central warp yarns 22 and 23 of the warp yarn group 2124 in the second layer are woven over all of the four weft yarns 56, 67, 80, and 91 of the second layer and under all four weft yarns 53, 70, 77, and 94 in the third layer. Therefore, the second layer and the third layer are tied to each other.

Figure 5E:
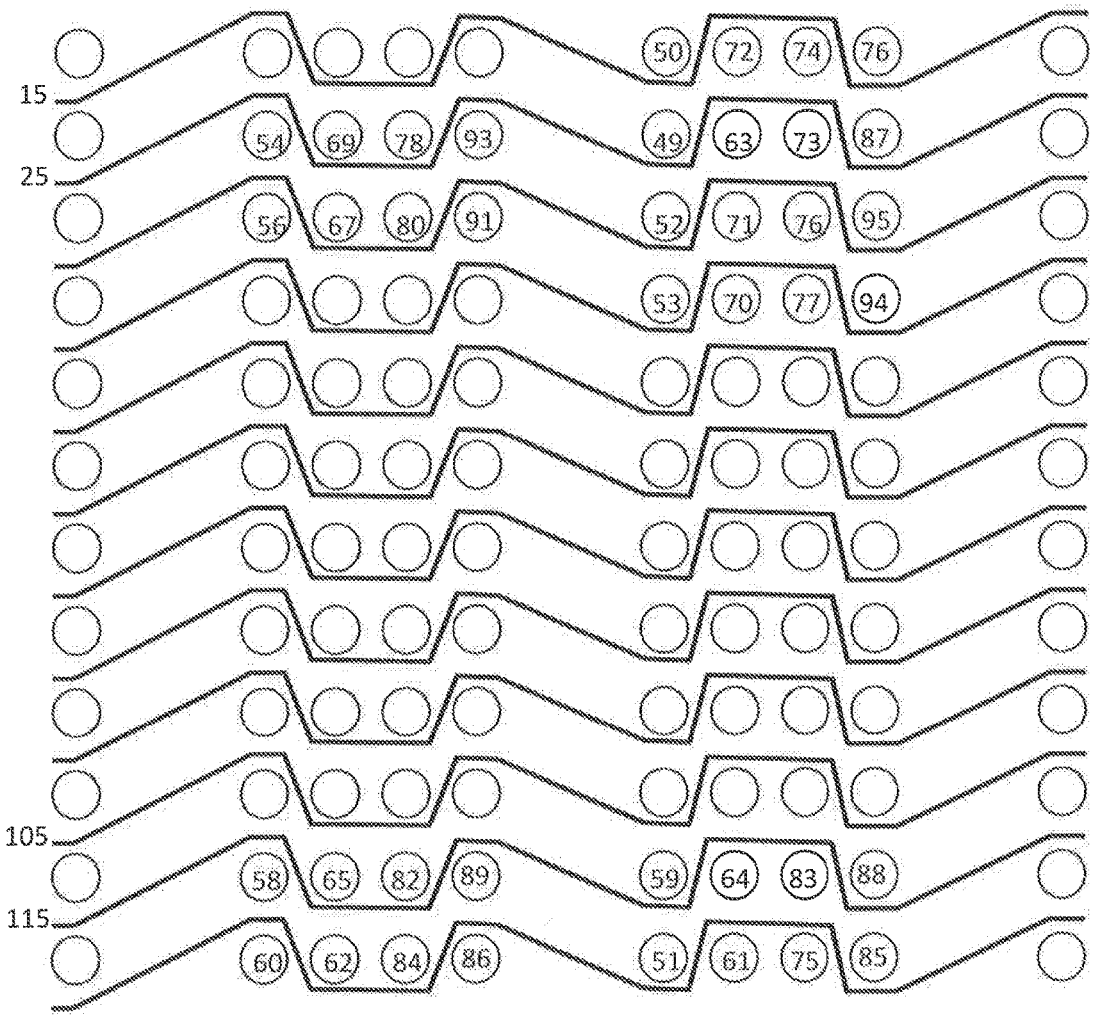
Figure 5F:
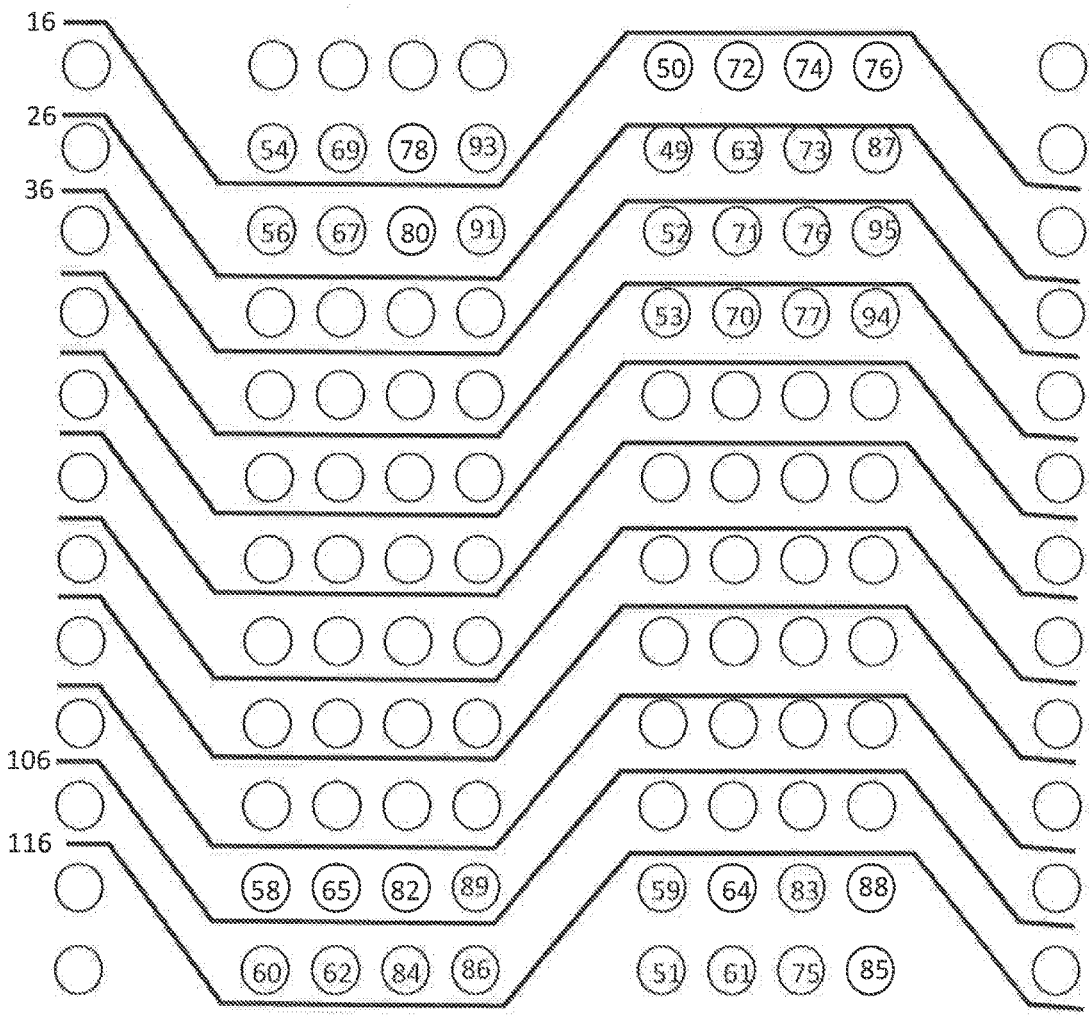
Figure 5G:
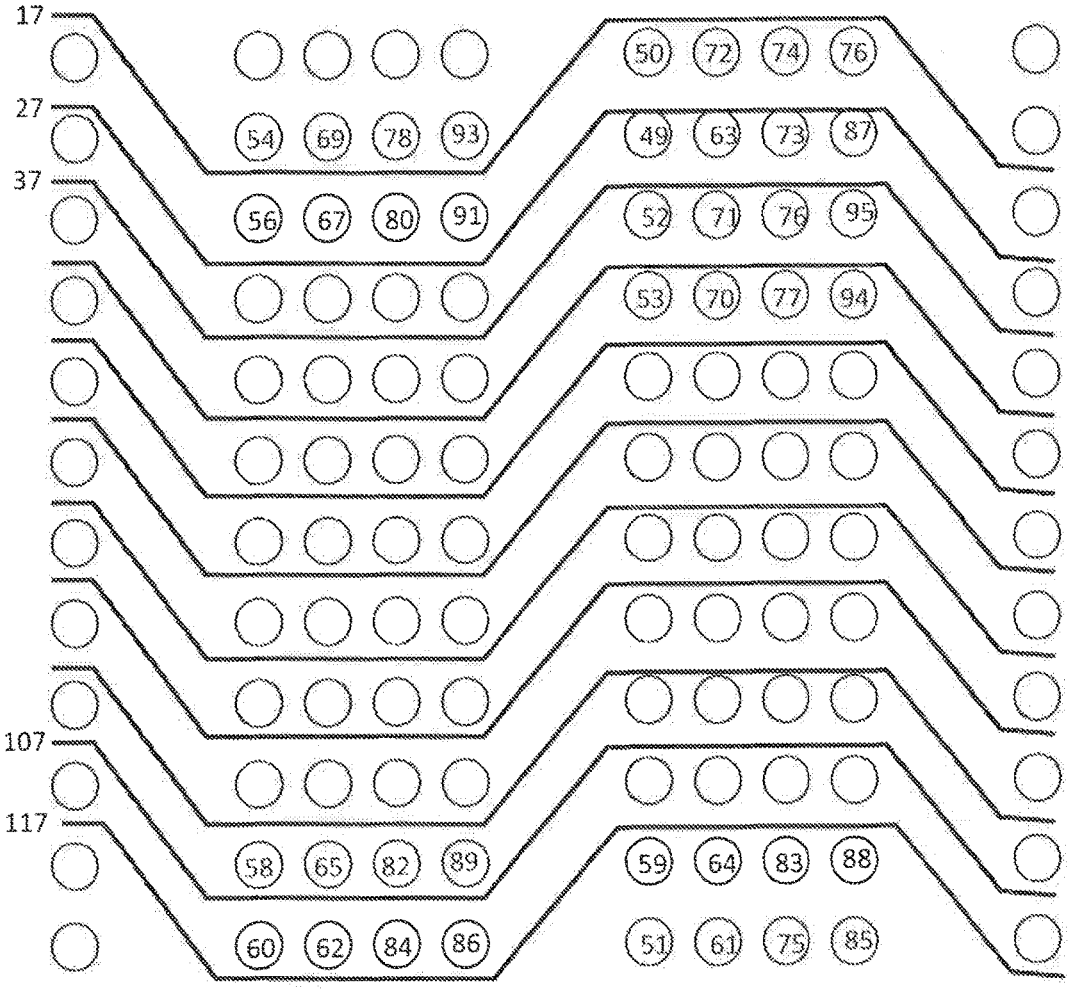
Figure 5H:
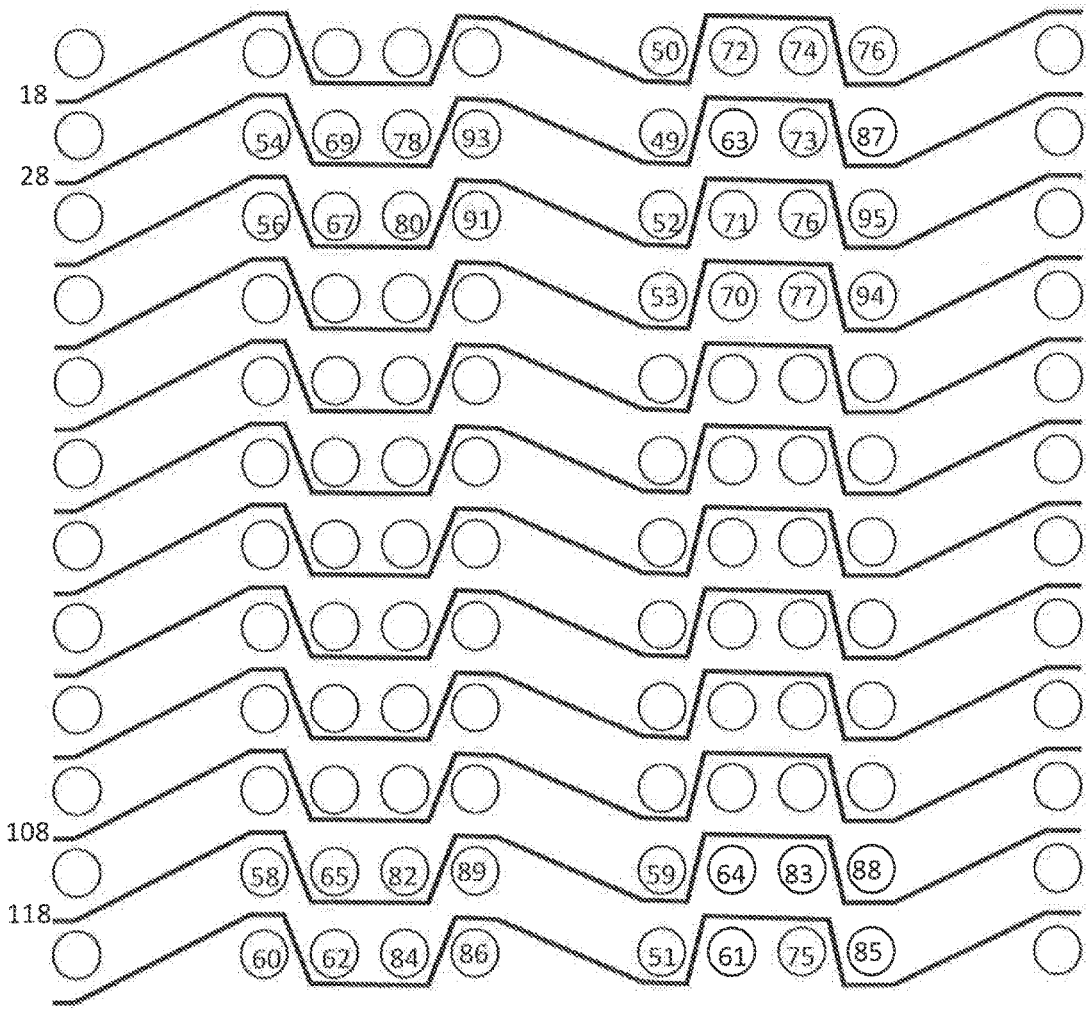

As shown in FIGS. 5E and 5H there are 4 yarns in a second group of warp yarns: edge warp yarns 15, 18, one on either side of central yarns 16, 17. During the weaving of the 3D mock leno weave pattern II, the first edge warp yarn 15 and the second edge warp yarn 18 are woven over the first edge weft yarn 54 of the first weft yarn group of the first layer, then under all the central weft yarns 69 and 78, and finally over the second weft edge yarn 93 in the weft yarn group. And edge warp yarns 15, 18 are then woven under the first edge weft yarn 49 of the first layer, then over all the central weft yarns 63 and 73, and finally under the second weft edge yarn 87, Edge warp yarns 15, 18 alternate the over/under in this manner for subsequent columns of weft yarns.

As shown in FIGS. 5F and 5G, the two central warp yarns 16 and 17 of the warp yarn group 15-18 in the first layer are woven under all of the four weft yarns 54, 69, 78, and 93 of the first layer and over the four weft yarns 50, 72, 74, and 76 of the layer above the first layer. Therefore, the first layer and the layer above the first layer are tied to each other.

In a similar manner, the first edge warp yarn 25 and second edge warp yarn 28 of the warp yarn group 25-28 in the second layer are woven over the first edge weft yarn 56 of the first weft yarn group of the second layer, then under the central weft yarns 67 and 80, and over the second weft edge yarn 91. And the first edge warp yarn 25 and the second edge warp yarn 28 are woven under the first edge weft yarn 52 of the second weft yarn group of the second layer, then over the central weft yarns 71 and 76, and finally under the second weft edge yarn 95.

The two central warp yarns 26 and 27 of the warp yarn group 25-28 in the second layer are woven under all of the four weft yarns 56, 67, 80, and 91 of the second layer and over all four weft yarns 49, 63, 73, and 87 in the first layer. Therefore, the second layer and the first layer are tied to each other.

Therefore, as shown in FIGS. 5A 5H, warp yarn 11 and warp yarn 21 may come in contact with each other, but weft yarn 93 and weft yarn 49 are inhibited from contacting each other, In fact, all the weft yarns in the columns containing yarns 45 and 54 are inhibited from contacting each other. As a result channels are formed through the thickness of the fabric layers.

In a similar manner, of the 4 weft yarns in groups of a particular layer, n, the two central weft yarns are woven with the warp yarns in the particular layer alternating between being woven under all of the four yarns in the warp yarn group in the same layer, n, and then woven over all of the four yarns in the warp yarn group in the upper layer n−1, which is over this particular layer n in the through-thickness direction.

For example, as shown in FIGS. 5A-5H, in a first group of four weft yarns 54, 69, 78, and 93, edge weft yarns 54, 93 are woven over first warp edge yarn 11, under all central warp yarns 12, 13 and then over second warp edge yarn 14 in the first warp group of the first layer, and then edge weft yarns 54, 93 are woven under first warp edge yarn 15, over all central warp yarns 16, 17 and then under second warp edge yarn 18 in the second warp group of the first layer.

As shown in FIGS. 5A-5H, in the first group of four weft yarns 54, 69, 78, and 93, central weft yarns 69, 78 are woven under all the warp yarns 11-14 in the first warp yarn group, and then over all the warp yarns 15-18 in the second warp yarn group.

In the second weft yarn group 49, 63, 73, and 87, weft edge yarns 49, 87 are woven under warp edge yarn 11, over all central warp yarns 12, 13 and then under second warp edge yarn 14, and then edge weft yarns 49, 87 are woven over first warp edge yarn 15, under central warp yarns 26, 27 of the second warp yarn group in the second layer and then under second warp edge yarn 18 of the second warp group of the first layer. Subsequent, weft edge yarns in each group alternate in a similar manner.

Central weft yarns 63, 73 of the second weft yarn group 49, 63, 73, and 87 are woven under the first edge warp yarn 15 of the second warp yarn group in the first layer, and then under the warp yarn 26, 27 of the second warp group in the second layer, and then under the second edge warp yarn 18 of the second warp yarn group in the first layer. Therefore, the first layer and the second layer are tied to each other.

Similarly, as shown in FIGS. 5A-5H, in a first group of four weft yarns 56, 67, 80, and 91 of the second layer, edge weft yarns 56, 91 are woven over first warp edge yarn 21, under all central warp yarns 22, 23 and then over second warp edge yarn 24 in the first warp group of the second layer, and then edge weft yarns 56, 91 are woven under first warp edge yarn 25, over all central warp yarns 26, 27 and then under second warp edge yarn 28 in the second warp group of the second layer.

As shown in FIGS. 5A-5H, in the first group of four weft yarns 56, 67, 80, and 91, central weft yarns 67, 80 are woven under all the warp yarns 21-24 in the first warp yarn group, and then over all the warp yarns 25-28 in the second warp yarn group.

In the second weft yarn group 52, 71, 76, and 95, weft edge yarns 52, 95 are woven under warp edge yarn 21, over all central warp yarns 22, 23 and then under second warp edge yarn 24, and then edge weft yarns 52, 95 are woven over first warp edge yarn 25, under central warp yarns 36, 37 of the second warp yarn group in the third layer and then under second warp edge yarn 28 of the second warp group of the second layer. Subsequent, weft edge yarns in each group alternate in a similar manner.

Central weft yarns 71, 76 of the second weft yarn group 52, 71, 76, and 95 are woven under the first edge warp yarn 25 of the second warp yarn group in the second layer, and then under the warp yarn 36, 37 of the second warp group in the third layer, and then under the second edge warp yarn 28 of the second warp yarn group in the second layer. Therefore, the second layer and the third layer are tied to each other.

Figure 6:
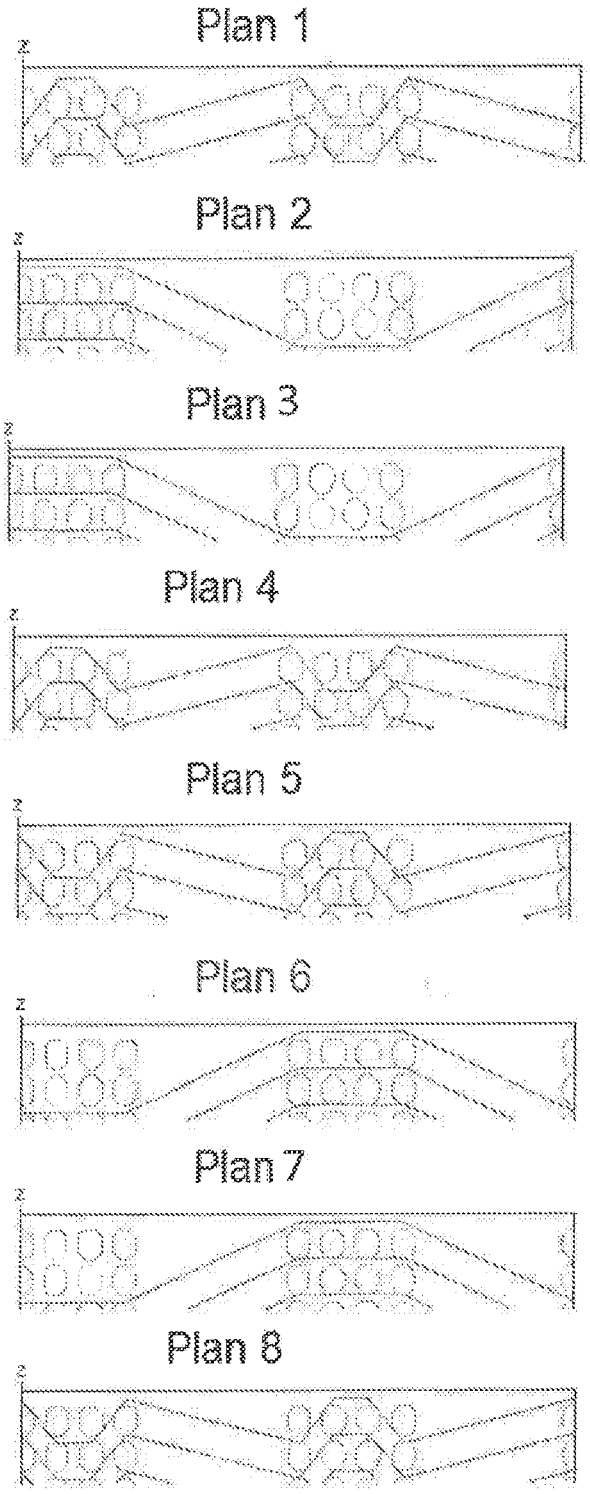
FIG. 6 illustrates the plans used to generate the top of a 3D woven preform with channels
of the present disclosure.

FIG. 6 illustrates the plans used to generate the top of a 3D woven preform with channels. The pattern, as shown in FIG. 6, works by allowing some columns of yarns (warp and weft) to repel each other (4 and 5; 8 and 1) while others enable compact nesting (1 and 4; 5 and 8). Plans 2, 3, 6, & 7 are used to tie one layer to the next.

The stiffness of the fiber yarns, combined with a specific over and under weave path, lead to a natural repulsion of some yarns and attraction of other yarns. This leads to the grouping of yarns in each direction that is beneficial for some applications. Stiffer yarns result in larger spacings between yarns, thus resulting in larger channels.

Certain selections of warp yarn groupings in the reed can mute or accentuate the formed paths or channels. Similarly, certain patterns of take-up spacing can also mute or accentuate the formed paths or channels. The most accentuated results come from arranging the yarns as in Plans 1-4 in a dent, Plans 5-8 in a dent, and smaller take-ups between weft yarn columns 1-4 and again 5-8.

Therefore, in the 3D woven preform of the instant invention, an open weave is accomplished by using only the up and down yarn movement pattern available on the weaving system and without using additional mechanical actuators.

Figure 7:
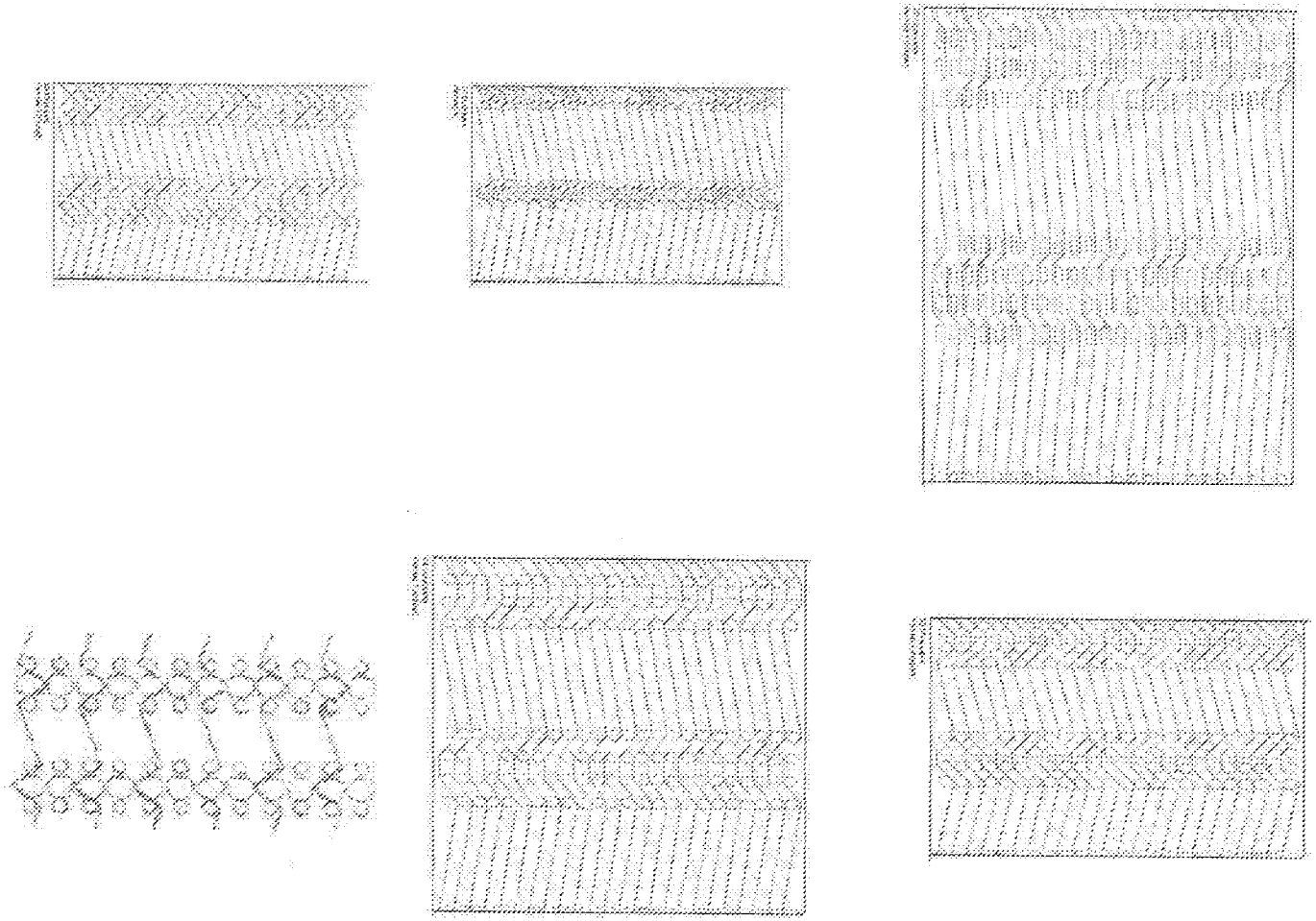
FIG. 7 illustrates other examples of 3D woven preforms of the present disclosure.

FIG. 7 illustrates other examples of 3D woven preforms. A variety of thicknesses (layers) and spacings may be used for a warp/weft column.

The 3D mock leno weave pattern has the following characteristics and features:

- make 3D woven preforms with higher thickness at a lower fiber weight at the same thickness as a conventional 3D pattern or laminated structure. For example, a 3D preform with a traditional fiber volume (FV) has a certain thickness and a certain weight, and a preform with open channels disclosed in the instant invention, which has the same thickness, has a weight less than that of the 3D preform with the traditional fiber volume;
- create through thickness channels for fluid to flow either during processing of the preform into a composite; or as a "cooling channel" when the preform or composite is used as part of another assembly requiring heat dissipation;
- vary the channel spacing by varying the number of warp yarns grouped together; vary the dimensions of the channels in the Z (through thickness) direction;
- have less "bruising", shoving or yarn displacement;
- have at least 3 warp and weft yarns in a group;
- stiffer warp and/or weft yarns will increase the repulsive force between yarn groups thus creating larger channels in the x or y planes (z being through thickness plane);
- vary take-up between yarn groupings to vary the channel size in the warp direction;
- groupings occur in both x-y plane directions, which results in "rectangular, other polygonal shaped channels";
- warp and/or weft yarns bind from one layer to the next layer below, or bind multiple layers with one yarn.

After the desired 3D woven preform structure has been formed, the structure may be impregnated in a matrix material to form a composite. The structure becomes encased in the matrix material and matrix material fills some or all of the interstitial areas between the constituent elements of the structure. The matrix material may be any of a wide variety of materials, such as epoxy, polyester, vinylester, ceramic, carbon and/or other materials, which also exhibit desired physical, thermal, chemical, and/or other properties. The materials chosen for use as the matrix may or may not be the same as that of the structure and may or may not have comparable physical, chemical, thermal or other properties. Typically, however, they will not be of the same materials or have comparable physical, chemical, thermal or other properties, because a common objective sought in using composites is to achieve a combination of characteristics in the finished product that is not attainable through the use of one constituent material alone. So combined, the structure and the matrix material may then be cured and stabilized in the same operation by thermosetting or other known methods, and then subjected to other operations toward producing the desired component. After being so cured, the then solidified masses of the matrix material are adhered to the structure. As a result, stress on the finished component, particularly via its matrix material acting as an adhesive between fibers, may be effectively transferred to and borne by the constituent material of structure. Further, if Chemical Vapor Infiltration (CVI) is utilized to add the matrix material to form the composite, some or all of the channels formed in the substrate might remain open and free of the resin material.

It should be appreciated that the yarns in the warp and weft directions may be of same or different materials and/or sizes. For example, the warp yarns and weft yarns can be made of carbon, nylon, rayon, fiberglass, cotton, ceramic, aramid, polyester, metal, polyethylene, and/or other materials that exhibit desired physical, thermal, chemical or other properties.

It should be appreciated that other 3D mock leno weaves can be used to create the polygonal shaped channels, and that the number of layers of warp yarns is at least two or more. It should also be appreciated that in some embodiments, all the channels extend through the entire preform thickness. In other embodiments, a plurality of channels extend through the entire thickness. That is, in a desired pattern, not all of the channels necessarily extend through the entire thickness of the preform.

It should also be appreciated that on one or both outer surfaces of the 3D woven preform, or one or both outer surfaces of the composite, other structures may be attached as a separate "skin" by methods such as stitch bonding, pinning, T-Forming (see U.S. Pat. No. 6,103,337), mechanically bolting, use of appropriate adhesives, or other methods known to those skilled in the art.

The invention claimed is:

1. A three-dimensional (3D) woven preform comprising:

a plurality of groups of warp yarns;

a plurality of groups of weft yarns, the warp yarns woven with the weft yarns to form a mock leno structure having a plurality of layers of the 3D woven preform, wherein a first group of weft yarns in a particular layer includes at least two first weft edge yarns and a first set of at least one weft central yarn, the first set of at least one weft central yarn binds warp yarns in the particular layer to warp yarns in a subsequent layer and the at least two first weft edge yarns include one disposed on each side of the first set of the at least one weft central yarn, and wherein a second group of weft yarns in the particular layer includes at least two second weft edge yarns and a second set of at least one weft central yarn, the first set of at least one weft central yarn binds warp yarns in the particular layer to warp yarns in a preceding layer and the at least two second weft edge yarns include one disposed on each side of the second set of the at least one weft central yarn, such that through thickness channels are formed in the multilayer preform.

2. The 3D woven preform of claim 1, wherein a first group of warp yarns in the particular layer includes a first set of at least one warp central yarn that binds weft yarns in the particular layer to weft yarns in the subsequent layer and at least two first warp edge yarns, one on each side of the first set of the at least one warp central yarn, and wherein a second group of warp yarns in the particular layer includes a second set of at least one warp central yarn that binds weft yarns in the particular layer to weft yarns in the preceding layer and at least two second warp edge yarns, one on each side of the second set of the at least one warp central yarn.

3. The 3D woven preform of claim 2, wherein the first and second weft edge yarns are woven over the first set of at least one warp central yarn and under the second set of at least one warp central yarn in the particular layer, and wherein the first and second warp edge yarns are woven over the first set of at least one weft central yarn and under the second set of at least one weft central yarn in the particular layer.

4. A composite comprising:

a three-dimensional (3D) woven preform of claim 1, wherein the preform is impregnated with matrix material.

5. A composite comprising:

a three-dimensional (3D) woven preform of claim 3, wherein the preform is impregnated with matrix material.

6. A method of forming a three-dimensional (3D) woven preform comprising:

forming groups of warp yarns in a plurality of layers of the 3D woven preform;

forming groups of weft yarns in the plurality of layers of the 3D woven preform;

forming a mock leno structure by weaving the warp yarns in the warp groups with weft yarns in the weft groups, wherein a first group of weft yarns in a particular layer includes at least two first weft edge yarns and a first set of at least one weft central yarn, the first set of at least one weft central yarn binds warp yarns in the particular layer to warp yarns in a subsequent layer and the at least two first weft edge yarns include one disposed on each side of the first set of the at least one weft central yarn, and wherein a second group of weft yarns in the particular layer includes at least two second weft edge yarns and a second set of at least one weft central yarn, the first set of at least one weft central yarn binds warp yarns in the particular layer to warp yarns in a preceding layer and the at least two second weft edge yarns include one disposed on each side of the second set of the at least one weft central yarn, such that through thickness channels are formed in the multilayer preform.

7. The 3D woven preform of claim 6, wherein a first group of warp yarns in a particular layer includes at least two first warp edge yarns and a first set of at least one warp central yarn, the first set of at least one warp central yarn binds weft yarns in the particular layer to weft yarns in a subsequent layer and the at least two first warp edge yarns include one disposed on each side of the first set of the at least one warp central yarn, and wherein a second group of warp yarns in the particular layer includes at least two second warp edge yarns and a second set of at least one warp central yarn, the first set of at least one warp central yarn binds weft yarns in the particular layer to weft yarns in a preceding layer and the at least two second warp edge yarns include one disposed on each side of the second set of the at least one warp central yarn.

8. The 3D woven preform of claim 7, wherein the first and second weft edge yarns are woven over the first set of at least one warp central yarn and under the second set of at least one warp central yarn in the particular layer, and wherein the first and second warp edge yarns are woven over the first set of at least one weft central yarn and under the second set of at least one weft central yarn in the particular layer.

9. A method of forming a composite comprising:

forming three-dimensional (3D) woven preform of claim 6, impregnating the 3D woven preform with matrix material.

10. A method of forming a composite comprising:

forming three-dimensional (3D) woven preform of claim 8, impregnating the 3D woven preform with matrix material.

* * * * *